United States Patent [19]

Wong et al.

[11] Patent Number: 4,691,177

[45] Date of Patent: Sep. 1, 1987

[54] WAVEGUIDE SWITCH WITH VARIABLE SHORT WALL COUPLING

[75] Inventors: Mon N. Wong, Torrance; Ann L. Peebles, Santa Monica, both of Calif.

[73] Assignee: Hughes Aircraft Company, Los Angeles, Calif.

[21] Appl. No.: 782,809

[22] Filed: Oct. 2, 1985

[51] Int. Cl.[4] ..... H01P 5/12; H01P 5/18

[52] U.S. Cl. ..... 333/113; 333/105; 333/108

[58] Field of Search ..... 333/101, 105, 108, 113, 333/117, 159, 259; 343/777

[56] References Cited

U.S. PATENT DOCUMENTS

| | | | |
|---|---|---|---|
| 2,876,421 | 3/1959 | Riblet | 333/11 |
| 2,955,268 | 10/1960 | Riblet | 333/98 |
| 3,056,096 | 9/1962 | Vane | 333/113 |
| 3,324,472 | 6/1967 | Sundberg et al. | 343/117 |
| 3,535,659 | 10/1970 | Salzberg | 333/113 |
| 4,127,829 | 11/1978 | Levy et al. | 333/113 |

*Primary Examiner*—Robert E. Wise

*Attorney, Agent, or Firm*—S. M. Mitchell; M. J. Meltzer; A. W. Karambelas

[57] ABSTRACT

A waveguide switch operable at microwave frequencies is formed of two waveguides of rectangular cross section with a longer wall and a shorter wall, the two waveguides sharing a common shorter wall. Two coupling windows are disposed within the common wall for coupling electromagnetic energy between the two waveguides, each coupling window introducing a 90° phase shift. Each window couples one-half the power of an electromagnetic wave from a first of the guides to a second of the guides. The common wall is parallel to the electric field of the coupled wave, with each wave being a TE wave. A 90° phase shift is introduced by each coupling with the result that utilization of both windows produces a summation of the two waves in the second of the waveguides and a cancellation of the two waves in the first of the waveguides. Gates are employed for selectively closing off either one or both of the windows to retain all of the power in the first waveguide, or to close off only one of the waveguides for an equal distribution of the power in both waveguides.

9 Claims, 4 Drawing Figures

WAVEGUIDE SWITCH WITH VARIABLE SHORT WALL COUPLING

BACKGROUND OF THE INVENTION

This invention relates to waveguide switches and, more particularly, to a pair of waveguides with a common wall in which are located a pair of coupling windows and rectractable shutter elements or gates for selectively coupling differing amounts of power among plural output terminals of the switch.

Switches for selectively coupling electromagnetic energy between waveguides are employed in a variety of situations. One situation of particular interest is in the construction of an antenna composed of an array of radiating elements. As is well known, both the relative phases and the relative amplitudes among microwave signals applied to the respective elements determines the direction and the shape of a resultant beam of radiation. While the number of radiating elements and the spacings therebetween set limitations on the shape of a beam, a substantial amount of beam shaping can be accomplished by varying the amplitude of signal applied to each of the radiating elements.

A case of particular interest involves the stepwise, or digital, switching of microwave power to selected ones of the radiating elements. In a large array, effective beam shaping can be accomplished by the simple expedient of applying full power, half power or zero power to selected ones of the radiating elements.

One example of the use of such an antenna system, incorporating both the antenna array and the switches, is the antenna system carried by a satellite circumnavigating the earth. As the satellite passes over a specific country, such as the United States, it is desirable to continuously reform the radiating beam of the antenna so as to illuminate certain areas of the country. For example, it may be desirable to illuminate the northeast and southeast portions, and subsequently the northwest and central portions of the country. The beam can be adaptively reconfigured as the satellite passes over the country by the use of electronically activated switches which switch the electromagnetic power selectively among the various antenna elements to provide a desired shape to the beam.

A problem arises in that one form of switch which has been proposed for use in such a satellite antenna system is limited to two possible switch configurations, namely, coupling input power to either of two output terminals of the switch. Thus, a transmitter or receiver connected to an input terminal of the switch can be coupled to either of two branches of a microwave network or to either of two radiating elements of the antenna. However, the switch is disadvantageous that an alternative distribution of power, particularly the coupling of one-half of the power from one output terminal and one-half of the power by the other output terminal cannot be accomplished. This provides an undesirable limitation upon the capability and facility for continuous reconfiguration of the beam of radiation.

SUMMARY OF THE INVENTION

The foregoing problem is overcome and other advantages are provided by a switch for radiant energy, and a microwave antenna feed incorporating such a switch for providing a desired shape to a beam of electromagnetic radiation from an antenna system incorporating the microwave feed.

In accordance with the invention, the switch comprises a first waveguide, and a second waveguide sharing a common wall with the first waveguide. Each of the waveguides supports a transverse-electric mode of wave propagation and has a rectangular cross section with a short wall and a long wall, the common wall being a short E-plane wall. The switch includes an input terminal, a first output terminal, and a second output terminal. The input terminal and the first output terminal are located at opposite ends of said first waveguide, while the second output terminal is located in said second waveguide.

A first window and a second window are disposed in the common wall for interconnecting the waveguides. Each of the windows has a length as measured along the first waveguide in a direction of energy propagation, equal to approximately one free-space wavelength of the radiant energy, the windows being spaced apart in the propagation direction by a distance greater than approximately one-tenth of the guide wavelength of the radiant energy.

The switch further comprises a gate assembly formed with a first gate located at the first window for limiting a flow of radiant energy through the first window, and a second gate located at the second window for limiting a flow of radiant energy through the second window. Included within the gate assembly is electromechanical apparatus for displacing the first and the second gates across their respective windows for opening and closing the respective windows to couple and to decouple the waveguides. The gate assembly provides for a maximum amount of power from the first output terminal and essentially no power from the second output terminal upon a closure of both gates, the gate assembly providing a coupling of approximately equal quantities of radiant energy to the first and the second output terminals upon a closure of one of the gates, the gate assembly providing for a maximum amount of power from the second output terminal and essentially no power from the first output terminal upon an opening of both of the gates.

Each of the gate assemblies comprises a set of parallel rods which set within the common wall. The rods are oriented in the vertical direction between the top and bottom walls of each of the waveguides, and are translatable in the vertical direction by the displacement apparatus for opening and closing a window. The rods are parallel to the electric field of the electromagnetic energy, and produce a short circuit which acts as a continuation of the common wall in the region of the window. When the rods are withdrawn from a window by the displacement apparatus, coupling of electromagnetic energy is provided by the open window. The displacement apparatus includes elements, such as solenoids which can be activated remotely by electric signals, such as would be provided by a beamformer. Thereby, individual switches of the antenna system can be continuously operated for reconfiguration of the beam for illumination of a region of the earth by a satellite carrying the antenna system.

BRIEF DESCRIPTION OF THE DRAWINGS

The aforementioned aspects and other features of the invention are explained in the following description, taken in connection with the accompanying drawing wherein.

DESCRIPTION OF THE PREFERRED EMBODIMENTS

Figure 1:
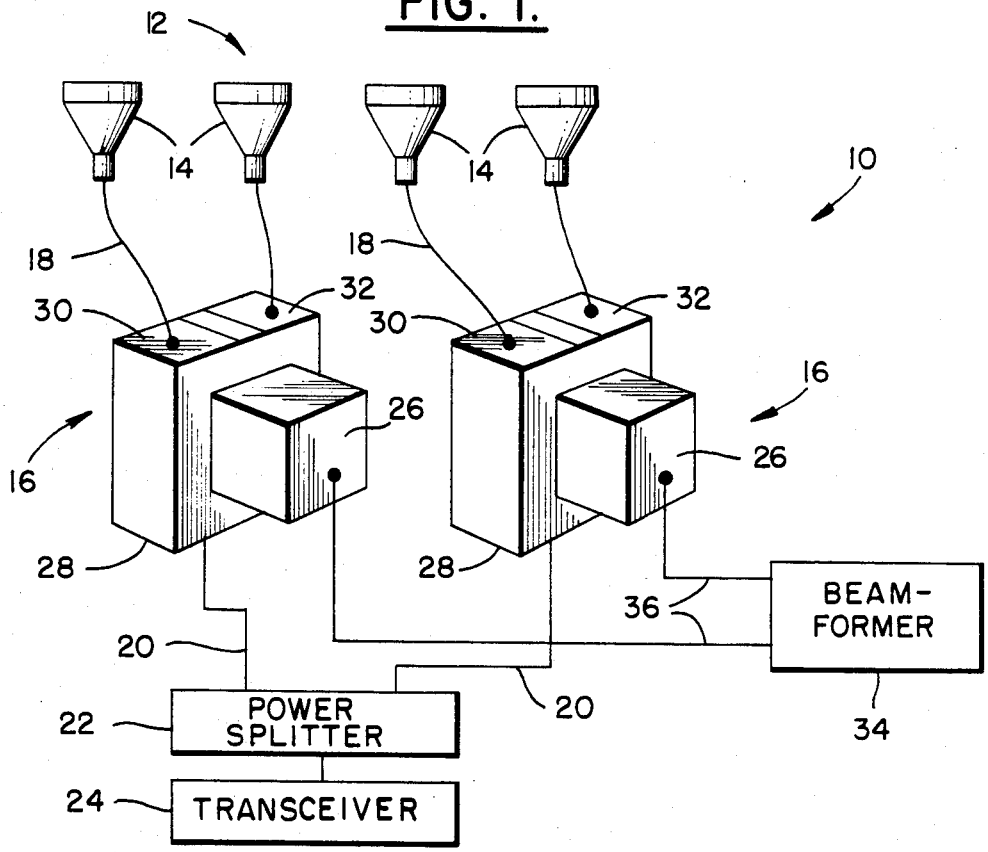
FIG. 1 shows a simplified view, in block diagrammatic form, of an antenna system incorporating the switch of the invention.

FIG. 1 shows a simplified diagrammatic view of an antenna system 10 including a phased array antenna 12 having four radiating elements 14. While the antenna 12, in practice, would comprise many radiating elements, only four of the elements 14 are shown to simplify the figure. The system 10 further comprises two switches 16 which incorporate the invention. One of the switches 16 is coupled to two of the elements 14 on the left side of the antenna 12, and the second switch 16 is coupled to the two elements 14 on the right side of the antenna 12. The connection of the switches 16 to the respective elements 14 is shown by a set of lines 18. The switches 16 are further connected via lines 20 to a power splitter 22, the latter connecting with a transceiver 24. In practice, the connections via lines 18 and 20 may be accomplished by either waveguides or coaxial cable. The transceiver 24 generates signals for transmission from the antenna 12 and receives signals incident upon the antenna 12.

As will be described with reference to FIGS. 2, 3, and 4, each of the switches 16 includes an electromechanical actuator such as a solenoid assembly 26 for operating the switch 16 for coupling power from an input port 28 to output ports shown as a through port 30 and a coupled port 32. All of the power of the input port 28 may be coupled to either one of the output ports 30 and 32. Or, in accordance with a feature of the invention, the power may be evenly divided between the through port 30 and the coupled port 32. Electric signals for driving the solenoid assemblies 26 are provided by a beamformer 34 via lines 36.

In operation of the system 10, the beamformer 34 may include a memory which stores switched positions for each of a plurality of desired shapes of beams of electromagnetic energy radiated from or received by the antenna 12. Thereby, in accordance with a selected beam shape, the beamformer 34 activates individual ones of the switches 16 to couple electromagnetic energy to or from the respective radiating elements 14 to attain the desired beam shape. With respect to a preferred embodiment of the invention, each of the switches 16 is presumed to operate at a microwave frequency of approximately 12 GHz (gigahertz).

Figure 2:
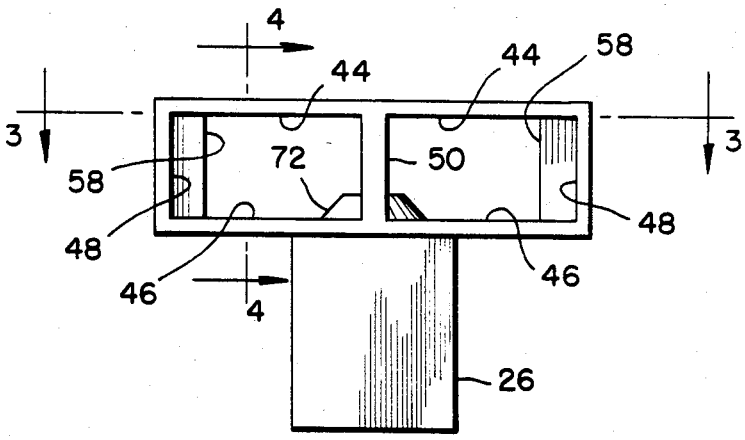
FIG. 2 is an end view of the switch of the invention, the view being taken looking into an input port and an isolation port of the switch.
Figure 4:
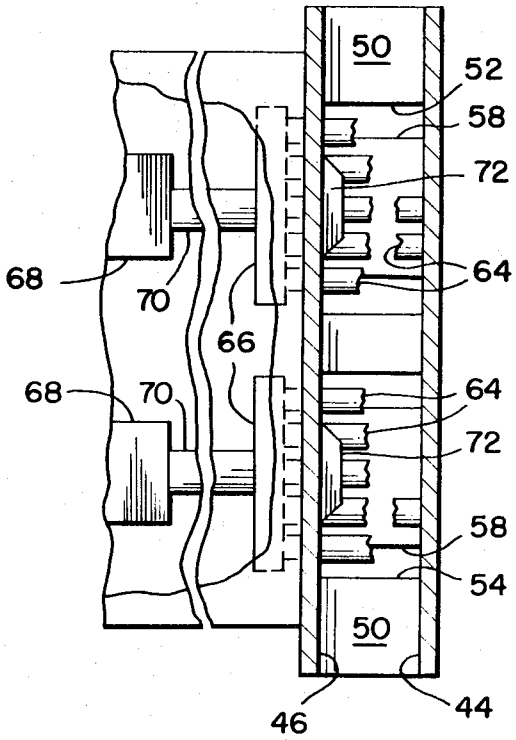
FIG. 4 is a vertical sectional view of the switch, taken along the line 4—4 in FIG. 2 showing rods of the gate assembly and a portion of rod displacement apparatus, portions of the rods being cut off to permit viewing of abutments along the outer short walls of the switch.
Figure 3:
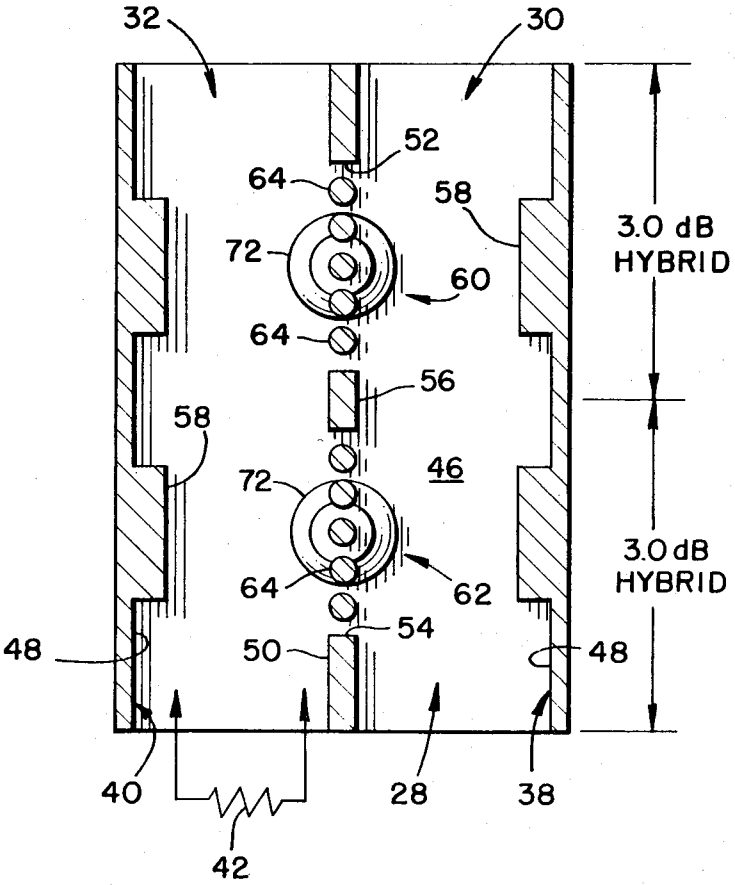
FIG. 3 is a plan view, in section, of the switch taken along the line 3—3 in FIG. 2.

With reference to FIGS. 2, 3, and 4, there are shown details in the construction of a switch 16 of FIG. 1. In accordance with the invention, each switch 16 comprises a pair of waveguides 38 and 40, the waveguide 38 terminating at the input port 28 and at one of the output ports, namely, the through port 30. The second waveguide 40 is terminated at one end with an isolater 42 which is indicated diagrammatically by the symbol of a resistor for absorbing electromagnetic energy, and at the opposite end by the other output port, namely, the coupled port 32.

Each of the waveguides 38 and 40 is constructed with the same configuration, each waveguide having a top wall 44, a bottom wall 46, an outer sidewall 48 and an inner sidewall 50 which is shared in common by the two waveguides 38 and 40. Each of the waveguides 38 and 40 has a rectangular transverse sectional configuration with a ratio of 2:1 between a long wall (top wall 34 or bottom wall 46) to short wall (sidewall 48 or 50).

Two apertures 52 and 54 are provided in the common sidewall 50 for coupling electromagnetic energy between the two waveguides 38 and 40. The two apertures 52 and 54 are spaced apart by a section 56 of the wall 50 having a length in excess of approximately one-tenth of the guide wavelength. Each of the apertures 52 and 54 function as a window and have a length of approximately one free-space wavelength. The spacing between the sidewalls 48 and 50 in each of the waveguides is three-quarters of the free-space wavelength of the electromagnetic energy at the center frequency of the transmission band.

The serial arrangement of the windows in the common wall of the switch 16 provides the configuration of two 3.0 dB (decibels) hybrid couplers.

In order to improve the coupling of the radiant energy through the apertues 52 and 54, abutments 58 are placed along the outer sidewalls 48. There are a total of four of the abutments 58 with two of the abutments 58 being positioned symmetrically about a center line of the aperture 52, and the remaining two abutments 58 being symmetrically positioned about a center line of the aperture 54. Each of the abutments 58 extends from the bottom wall 46 to the top wall 44, and has a length of approximately one-half of a free-space wavelength. The thickness of each abutment 58, as measured in a transverse cross section of the waveguides 38 and 40, is approximately one tenth of the free-space wavelength so as to provide a reduced cross-sectional dimension at the window of each hybrid coupler without introducing any significant reflection coefficient.

With respect to the construction of the isolator 42, the isolator may be constructed in the well known fashion of a wedge of material which absorbs electromagnetic energy at the microwave frequency of interest, and may be positioned within a section of waveguide (not shown) connected to the waveguide 40 by conventional means such as flanges (not shown). Similarly, connection of waveguides to the coupled port 32 of the waveguide 40, and to the input port 28 and the through port 30 of the waveguide 38 can be accomplished in a well known fashion such as by the use of flanges (not shown).

Gates 60 and 62 are provided respectively in the apertures 52 and 54 for closing and opening the windows of these apertures to the flow of radiant energy. Each of the gates 60 and 62 comprises a set of metallic rods 64, the rods 64 being composed of an electrically conducting material such as brass or aluminum, and being located within a plane of the sidewall 50 so as to provide an electrical short circuit to the electric field of radiant energy propagating in each of the waveguides 38 and 40. The radiant energy is presumed to have an electric field directed parallel to the sidewall 50.

In the preferred embodiment of the invention, each of the gates 60 and 62 is provided with five of the rods 64. The rods are spaced apart with a spacing less than one-tenth of the free-space wavelength as measured between the outer surfaces of the rods 64. Thereby, as viewed electrically, a closure of a gate 60 or 62 effectively closes the corresponding window to the flow of electromagnetic energy.

Each of the gates 60 and 62 further comprises a brace 66 for supporting the set of five rods 64 of the gate. The rods 64 extend upward from the brace 66 via through holes in the bottom wall 46 to the region of the windows. The solenoid assembly 26 includes two solenoids 68 having plungers 70 extending therefrom and connecting with the braces 66 in respective ones of the gates 60 and 62. Activation of the solenoids 68 introduces a translation of the respective plungers 70 and the respective gates 60 and 62 whereby the rods 64 can be moved between the bottom wall 46 and the top wall 44 along paths lying within the respective apertures 52 and 54. Each of the gates 60 and 62 is individually operated by its respective solenoid 68 to provide for a retraction of the rods 64 of the gate from the region of a window into the solenoid assembly 26, or for an extension of the rods 64 from the solenoid assembly 26 into the region of the window. Retraction of the rods 64 in either one of the apertures 52 and 54 constitutes an opening of the corresponding window to permit the coupling of microwave energy between the two waveguides 38 and 40. Extension of the rods 64 into one of the apertures 52 and 54 provides for a closing of the respective window to the flow of microwave energy. In this way, by electrical activation of the solenoids 68 in the assembly 26, the gates 60 and 62 of the switch 16 can be opened or closed.

Tuning buttons 72 are located on the bottom wall 46, and extend along a center line of each of the apertures 52 and 54 into the respective windows. Each of the buttons 72 has the form of a truncated cone with a thickness of 0.050 inch, a larger diameter of 0.600 inch, and a small diameter of 0.250 inch. Other dimensions in the switch 16 are as follows. The length of each of the apertures 52 and 54 is 1.035 inches; the diameter of each of the rods 64 is 0.060 inch; and each of the waveguides 38 and 40 is type WR-75 supporting Ku band electromagnetic energy having a spacing between sidewalls of 0.750 inch. The buttons 72 provide for an improved matching of impedance in the coupling of radiant energy between the two waveguides 38 and 40. Also, the reduced cross section of the waveguides 38 and 40 at the sites of each of the abutments 58 enhances the coupling of radiant energy through each of the windows. The switch 16 may be fabricated of brass or aluminum. In accordance with a feature of the invention, the switch 16 is fabricated with reduced size, the length of the switch being only 3.4 inches.

In operation, during the transmittal of energy from the input port 28 to each of the output ports, namely, the through port 30 and the coupled port 32, the radiant energy can flow in either of preselectable quantities between the input port and the two output ports. The quantity of energy to be coupled to each of the output ports is selected by the opening and the closing of the windows of the apertures 52 and 54 by the respective gates 60 and 62. Upon a closure of both of the gates 60 and 62, there is essentially no coupling of energy via the apertures 52 and 54, in which case all of the radiant energy incident upon the input port 28 exits via the through port 30.

In the event that one of the gates 60 and 62 is opened and other of the gates 60 and 62 is closed, then the switch 16 acts a single 3.0 dB hybrid coupler with the result that half of the energy exits via the through port 30 and the other half of the energy exits via the coupled port 32. In the event that both of the gates 60 and 62 are open, then essentially all of the microwave energy from the input port 28 is coupled via the two windows to exit the switch 16 at the coupled port 32 with essentially no microwave energy exiting the switch 16 via the through port 30.

As was explained with reference to FIG. 1, the remote activation of the solenoids 68 of the assembly 26 by electric signals from the beamformer 34 permits the coupling of microwave energy to either of two radiating elements 14 in a pair of such radiating elements, or to each of the pair of radiating elements 14 in equal quantities. Thereby, the shape of the beam of radiation produced by the antenna 12 can be selected in accordance with an amplitude taper applied across the array of radiating elements by the selective application of radiant energy to the elements in accordance with the operations of the switches 16.

It is noted that a switch 16 is reciprocal in its operation such that incoming energy, incident upon either of the output ports, namely, the through port 30 and the coupled port 32, can be coupled back to the input port 28 along a path of propagation which is the reverse to that disclosed above for the transmission of radiant energy.

By way of alternative embodiments, it is noted that the solenoid assembly 26 may be placed on the opposite side of the switch 16 so as to set upon the top wall 44. In this case, the rods 64 would extend downward from the top wall 44 and rest against the button 72 in each of the apertures 52 and 54. With this latter embodiment, the lengths of the rods 64 would differ slightly, the center rods in each window being somewhat shorter than the outer rods to accommodate the shape of the button 72.

With respect to the theory of operation of the switch 16, it is noted that the hybrid coupling through one of the windows introduces a 90° degree phase shift to an electric field coupled through the window. In the case where both windows are open, the coupling through the first window (nearest the input port 28) results in two traveling waves of differing phase but of equal amplitude, one wave being in the guide 38 and the other wave being in the guide 40.

Upon reaching the second window, the second window also introduces a 90° phase shift to an electric field coupled via the second window. The two waves, upon reaching the second window, interact to provide the sum of the two waves at the coupled port 32 and the difference of the two waves at the through port 30. As a result, all of the power exits via the coupled port 32 and essentially none of the power exits via the through port 30.

In the case that only one window is open, the switch 16 acts as a 3.0 dB coupler with an equal splitting of power between the two waveguides. In the event that both of the gates are closed, the waveguide 40 is effectively isolated from the waveguide 38 so that all power is retained within the waveguide 38. This provides the three different cases of output power coupling. The preferred embodiment of the switch 16 is operated over a frequency band of 11.7 GHz to 12.2 GHz with near-unity standing wave ratio.

It is to be understood that the above described embodiments of the invention are illustrative only, and that modifications thereof may occur to those skilled in the art. Accordingly, this invention is not to be regarded as limited to the embodiments disclosed herein, but is to be limited only as defined by the appended claims.

What is claimed is:

1. A switch for radiant energy comprising:

a first waveguide, and a second waveguide sharing a common wall with said first waveguide;

an input terminal, a first output terminal, and a second output terminal; said input terminal and said first output terminal being located at opposite ends of said first waveguide; said second output terminal being located in said second waveguide;

a first window and a second window disposed in said common wall and connecting said first waveguide with said second waveguide; each of said windows having a length, as measured along said first waveguide in a direction of energy propagation, equal to approximately one free-space wavelength of the radiant energy, said windows being spaced apart in said direction by a distance greater than approximately one-tenth of the guide wavelength of the radiant energy; and gate means including a first gate located at said first window for limiting a flow of radiant energy through said first window, and a second gate located at said second window for limiting a flow of radiant energy through said second window; said gate means further comprising means for displacing said first and said second gates, across their respective windows for opening and closing the respective windows to couple and to decouple said first and said second waveguides, said gate means providing for a maximum amount of power from said first output terminal and essentially no power from said second output terminal upon a closure of both said first and said second gates, said gate means providing a coupling of approximately equal quantities of radiant energy to said first and said second output terminals upon a closure of one of said gates, and said gate means providing for a maximum amount of power from said second output terminal and essentially no power from said first output terminal upon an opening of both of said first and said second gates.

2. A switch according to claim 1 wherein said first gate and said second gate each comprise a mechanical barrier of electrically conducting material which acts as an extension of said common wall upon a closure of either of said gates.

3. A switch according to claim 2 wherein said mechanical barrier comprises a set of rods spaced apart by a distance substantially less than a free space wavelength of electromagnetic energy propagating through said switch, said rods being parallel to an electric field of the electromagnetic energy.

4. A switch according to claim 3 further comprising tuning buttons disposed in respective ones of said windows, each of said buttons being disposed on a waveguide wall which is perpendicular to said common wall.

5. A switch according to claim 4 further comprising means for reducing a cross section of said first waveguide and of said second waveguide at the locations of said first window and said second window for improving the coupling of electromagnetic energy via said windows.

6. A switch according to claim 5 wherein said reducing means is in the form of an abutment having a length equal to approximately one-half the length of the corresponding window.

7. A switch for radiant energy comprising:

a first waveguide, and a second waveguide sharing a common wall with said first waveguide;

an input terminal, a first output terminal, and a second output terminal; said input terminal and said first output terminal being located at opposite ends of said first waveguide; said second output terminal being located in said second waveguide;

a first and a second coupling means disposed in said common wall and connecting said first waveguide with said second waveguide; each of said coupling means introducing a 90° phase shift to electromagnetic energy coupled through said common wall, each of said coupling means being capable of coupling one-half the power of electromagnetic energy in one of said waveguides to the other of said waveguides, the combined action of both of said coupling means providing at said second output terminal a summation of the electromagnetic waves in said first and said second waveguides and a cancellation at said first output terminal of the electromagnetic waves in each of said waveguides, and wherein said electromagnetic energy is applied to said input terminal;

gate means including a first gate located at said first coupling means for limiting a flow of radiant energy through said first coupling means, and a second gate located at said second coupling means for limiting a flow of radiant energy through said second coupling means; said gate means further comprising means for operating said first and said second gates for opening and closing the respective coupling means to couple and to decouple said first and said second waveguides, said gate means providing for a maximum amount of power from said first output terminal and essentially no power from said second output terminal upon a closure of both said first and said second coupling means, said gate means providing a coupling of approximately equal quantities of radiant energy to said first and said second output terminals upon a closure of one of said coupling means, and said gate means providing for a maximum amount of power from said second output terminal and essentially no power from said first output terminal upon an opening of both of said first and said second coupling means.

8. A switch according to claim 7 wherein said first coupling means is configured as a window, and said second coupling means is configured as a window, said first and said second gates being mechanically operable to provide for a physical closure and opening of respective ones of said windows.

9. An antenna system including an antenna comprising an array of radiating elements, a feed structure, and a beamformer; said feed structure connecting with said elements for coupling radiant energy therewith, said feed structure comprising a set of waveguides and a set of switches interconnecting said waveguides for selectively activating a flow of radiant energy to selected ones of said elements, and said beamformer driving said switches to shape a contour of a radiation beam pattern, and wherein each of said switches comprises:

a first waveguide, and a second waveguide sharing a common wall with said first waveguide;

an input terminal, a first output terminal, and a second output terminal; said input terminal and said first output terminal being located at opposite ends of said first waveguide; said second output terminal being located in said second waveguide;

a first window and a second window disposed in said common wall and connecting said first waveguide with said second waveguide; each of said windows having a length, as measured along said first waveguide in a direction of energy propagation, equal to approximately one free-space wavelength of the radiant energy, said windows being spaced apart in said direction by a distance greater than approximately one-tenth of the guide wavelength of the radiant energy;

gate means including a first gate located at said first window for limiting a flow of radiant energy through said first window, and a second gate located at said second window for limiting a flow of radiant energy through said second window; said gate means further comprising means for displacing said first and said second gates across their respective windows for opening and closing the respective windows to couple and to decouple said first and said second waveguides, said gate means providing for a maximum amount of power from said first output terminal and essentially no power from said second output terminal upon a closure of both said first and said second gates, said gate means providing a coupling of approximately equal quantities of radiant energy to said first and said second output terminals upon a closure of one of said gates, and said gate means providing for a maximum amount of power from said second output terminal and essentially no power from said first output terminal upon an opening of both of said first and said second gates.

* * * * *